United States Patent [19]

Ohtaka et al.

[11] Patent Number: 5,021,003

[45] Date of Patent: Jun. 4, 1991

[54] APPARATUS FOR CONFIRMING FITTING OF ELECTRIC CONNECTOR

[75] Inventors: Kazuto Ohtaka; Shigemitsu Inaba, both of Shizuoka, Japan

[73] Assignee: Yazaki Corporation, Tokyo, Japan

[21] Appl. No.: 553,846

[22] Filed: Jul. 18, 1990

[30] Foreign Application Priority Data

Jul. 18, 1989 [JP] Japan ..... 1-183602

[51] Int. Cl.[5] ..... H01R 13/627

[52] U.S. Cl. ..... 439/357; 439/372

[58] Field of Search ..... 439/350, 352–355, 439/358, 357, 372, 484, 680

[56] References Cited

U.S. PATENT DOCUMENTS

| | | | |
|---|---|---|---|
| 4,582,378 | 4/1986 | Fruchard | 439/350 |
| 4,602,839 | 7/1986 | Winger | 439/358 |
| 4,634,204 | 1/1987 | Detter et al. | 439/352 |
| 4,714,433 | 12/1987 | Rider, Jr. | 439/357 |
| 4,871,323 | 10/1989 | Ohsumi | 439/347 |

*Primary Examiner*—David L. Pirlot
*Assistant Examiner*—Hien D. Vu
*Attorney, Agent, or Firm*—Sughrue, Mion, Zinn, Macpeak & Seas

[57] ABSTRACT

An apparatus for confirming the fitting of an electric connector in which a male connector housing is fitted in a hood of a female connector housing so as to connect together metal terminals received respectively in the terminal receiving chambers of the male and female connector housings. A lock lever, having a holder spring, is pivotally connected at one end to a first side portion of the hood. A locking plate, having a provisional locking groove and a complete locking groove, is formed on a second side portion of the hood. Both the provisional and complete locking grooves are engageable with the holder spring. A fitting confirmation projection is formed on a reverse surface of the lock lever, and interferes with the male connector housing when the fitting of the male connector housing is imperfect, thereby preventing the engagement between the holder spring and the complete locking groove. The apparatus also may be used when a hood of a female connector housing is fitted in an electronic unit case so as to provide an open window in the electronic unit case. In this embodiment, a manipulation press portion is formed on a second end of the lock lever. Additionally, a screen portion is formed on the press portion so as to close the window in the electronic unit case to prevent foreign matter from penetrating the electronic unit case.

19 Claims, 6 Drawing Sheets

APPARATUS FOR CONFIRMING FITTING OF ELECTRIC CONNECTOR

BACKGROUND OF THE INVENTION

The present invention relates to a device for confirming the fitting of an electric connector used in an electric wiring in a vehicle.

In an electric connector, a pair of mating connector housings are fitted together so as to connect together female and male metal terminals received respectively in the connector housings. In order to ensure such an electrical connection, a locking device is provided between the two housings to prevent them from becoming disengaged FIG. 5 shows a conventional locking device. A locking arm b, deformable upwardly and downwardly, is provided on an outer peripheral wall of a male connector housing a, and a retaining hole f is formed in a hood e of a female connector housing d. A retaining projection c of the locking arm b is engageable in the retaining hole f. When the depth of fitting of the housing a into the hood e reaches a predetermined level the retaining projection c is engaged in the retaining hole f to make the male connector housing a and the female connector housing d a single locked mechanism.

The assembly and fitting operations of the electric connector are performed manually. Since numerous connectors normally must be assembled, some connector products may be in an unlocked condition resulting from an imperfect fitting due to operator error. It is difficult to discover such unlocked products visually during a subsequent inspection stage. Another problem is that the locking strength between the male and female housings can be increased by forming the locking arm b into a lever-like shape whose opposite ends are supported. However, if the locking strength between the male and female housings is excessive, this excessive locking strength, together with the resistance offered by the metal male and female terminals, makes the fitting operation of the housings difficult. Therefore, the locking strength heretofore has been purposely limited. As a result, when a force E perpendicular to the arm b is imparted thereon, the locking arm may be released inadvertently.

This problem of the locking between the connector housings becoming inadvertently released must be avoided, particularly when the electric connector is used in a wiring system for an air-bag device in a vehicle. Further, imperfect fitting and inadvertent release of the locking mechanism cannot be tolerated because of safety considerations.

SUMMARY OF THE INVENTION

In view of the above-described problems of the conventional mechanisms, it is an object of the invention to provide confirmation of the fitting of an electric connector, thus preventing an imperfect fitting between the male and female connector housings, and providing for increased locking strength and an increased reliability in an electrical connection.

According to the present invention, there is provided a device for confirming the fitting of an electric connector wherein a male connector housing is fitted in a hood of a female connector housing so as to connect together metal terminals received respectively in the terminal receiving chambers of the two housings, the device comprising:

a lock lever, having a holder spring, pivotally connected at one end to one side portion of the hood; a lock plate, having a provisional locking groove and a complete locking groove separated by an inclined surface, formed on the other side portion of the hood, the two locking grooves being engageable with the holder spring; and a fitting confirmation projection formed on a reverse surface of the lock lever, the fitting confirmation projection interfering with the male connector housing when the fitting of the male connector housing is imperfect, thereby preventing the engagement between the holder spring and the complete locking groove.

Additionally, when the above-described device is incorporated in an electronic unit case for controlling an air-bag device or the like, in order to prevent foreign matter from penetrating into the case through a small lock lever-manipulating window, a screen portion for closing the small window preferably is provided.

Thus, with the invention, the lock lever is not completely locked unless the female and male connector housings are completely fitted together. Therefore, an imperfect fitting can be checked easily during the fitting operation. Hence, after confirming the fitting of the two housings, the lock lever is completely locked relative to the lock plate, and simultaneously the locking between the two housings is achieved by the above-described fitting confirmation projection.

Additionally, if the conventional lock device, such as that shown in FIG. 5, is provided between the two housings, this together with the projection of the lock lever provides a double lock, which markedly improves the reliability of an electrical connection.

BRIEF DESCRIPTION OF THE DRAWINGS

The above and other objects, features, and advantages of the invention will become more apparent from the following detailed description when read in conjunction with the accompanying drawings in which.

DETAILED DESCRIPTION OF THE PREFERRED EMBODIMENT

Figure 1:
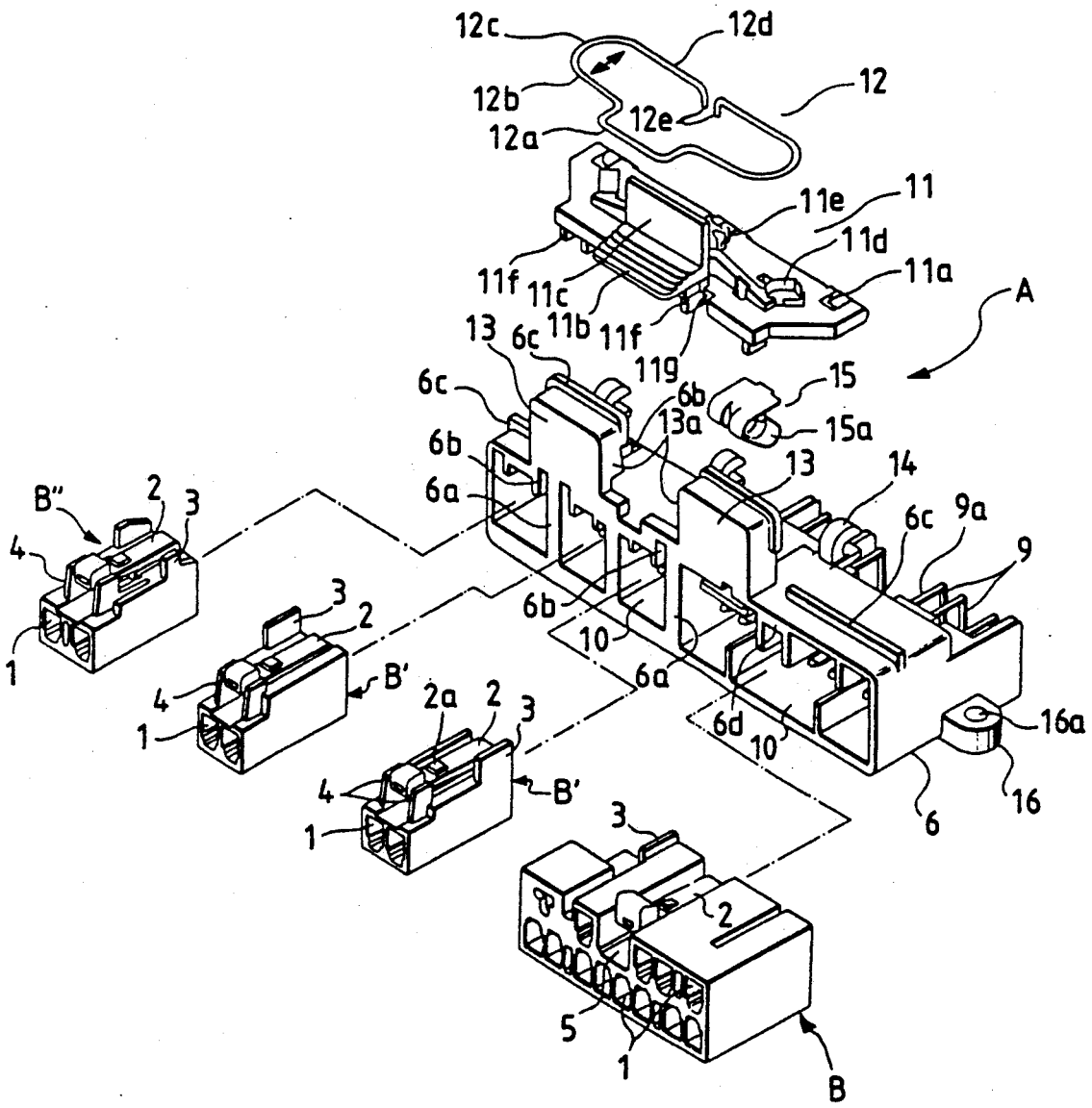
FIG. 1 is an exploded perspective view of one embodiment of the invention, showing a female connector housing, male connector housings, a lock lever, etc.
Figure 2:
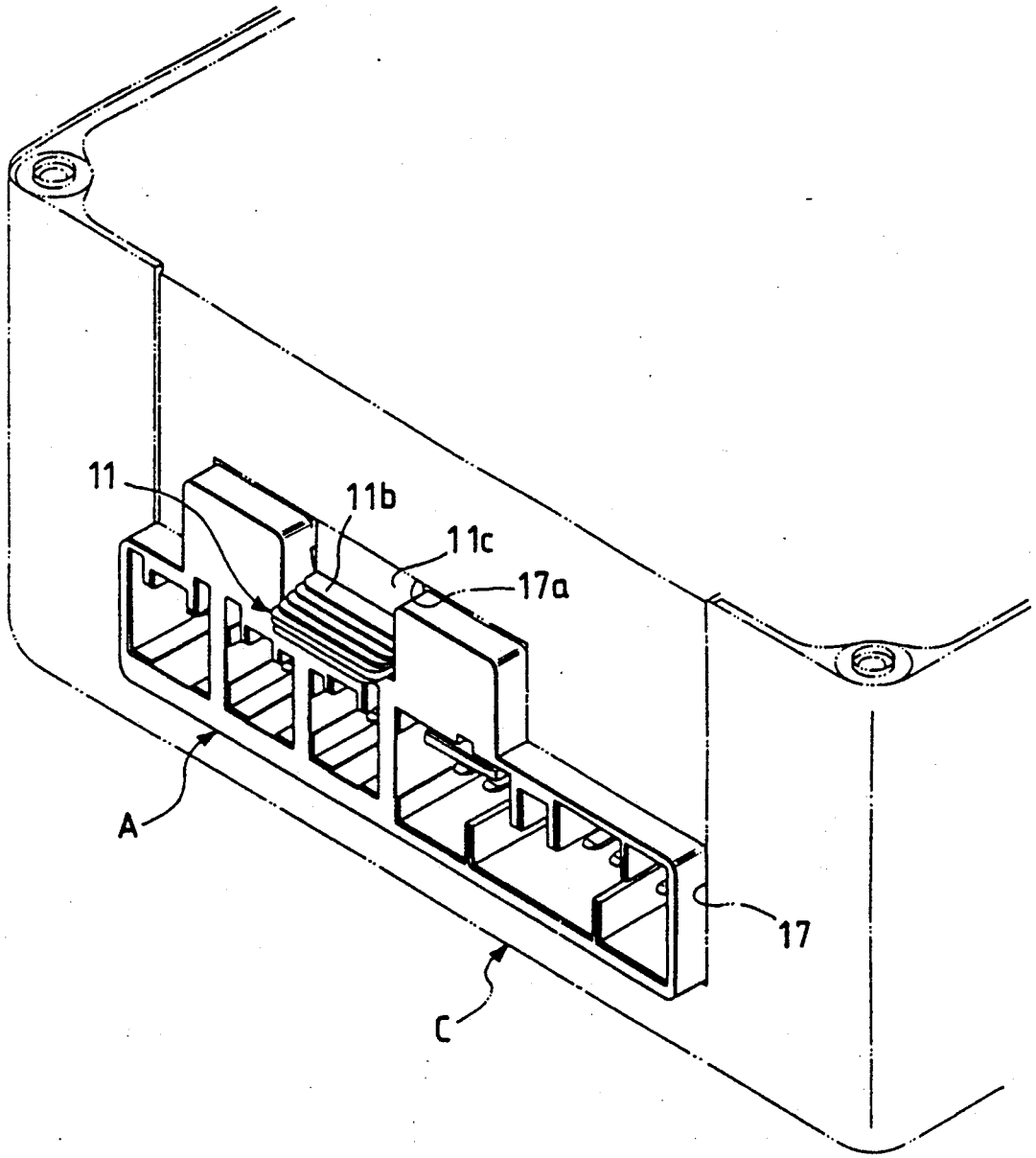
FIG. 2 is a perspective view, showing the female connector housing with the lock lever as attached to an electronic unit case.
Figure 3A:
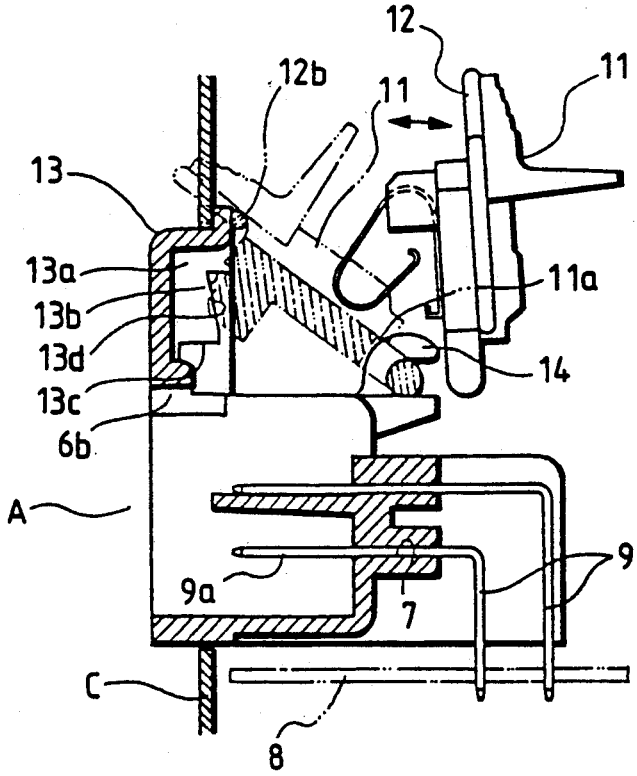
FIGS. 3(*a*) to 3(*e*) are cross-sectional views, showing the connection of the lock lever and the operation thereof; operation of a screen portion of the lock lever.
Figure 3B:
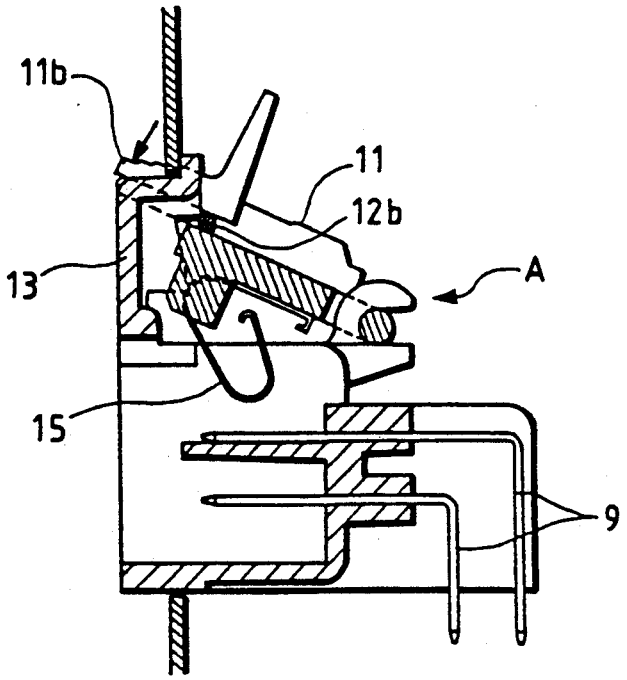
Figure 3C:
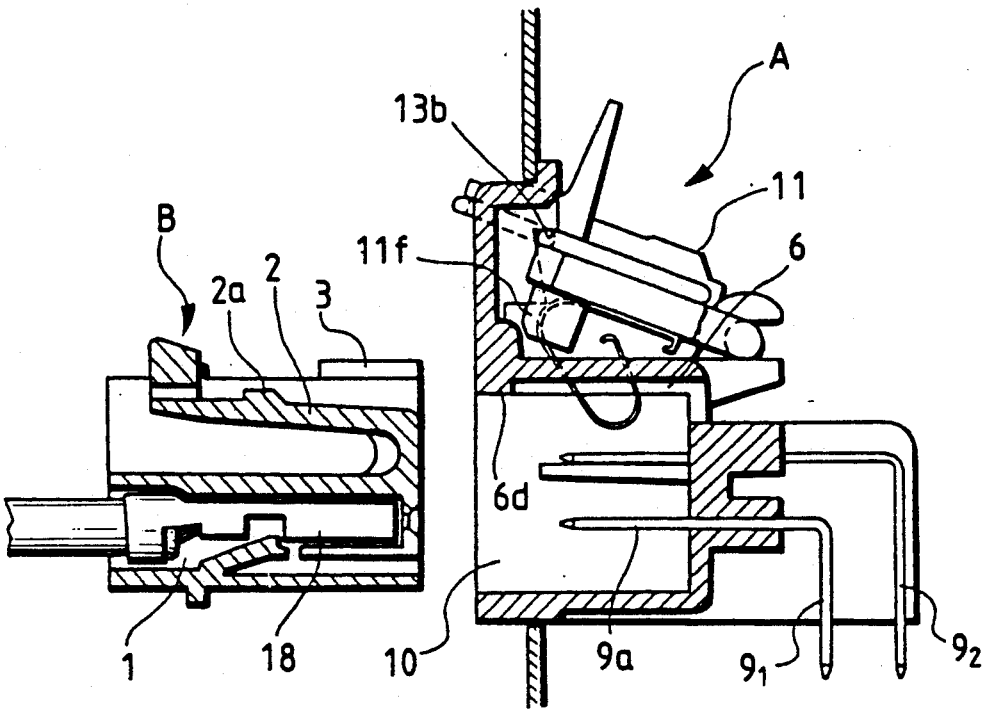
Figure 3D:
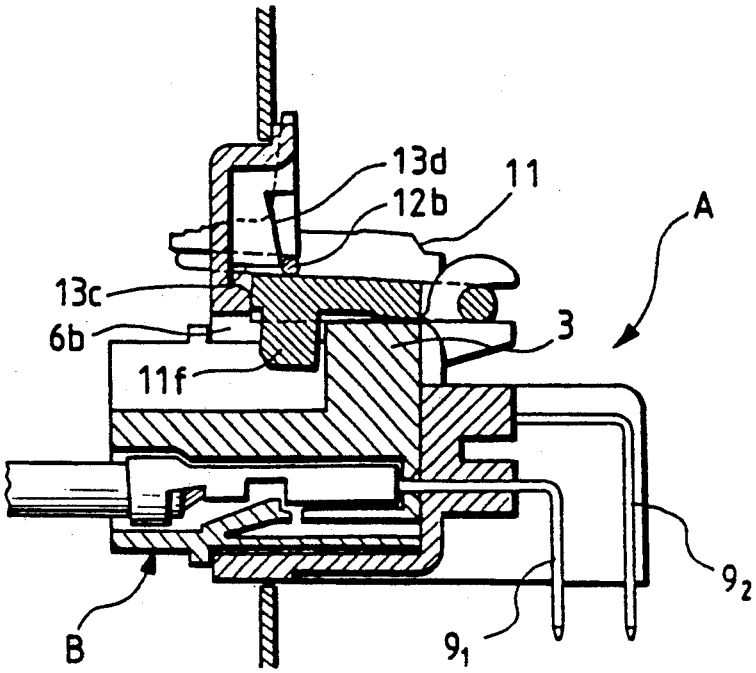
Figure 3E:
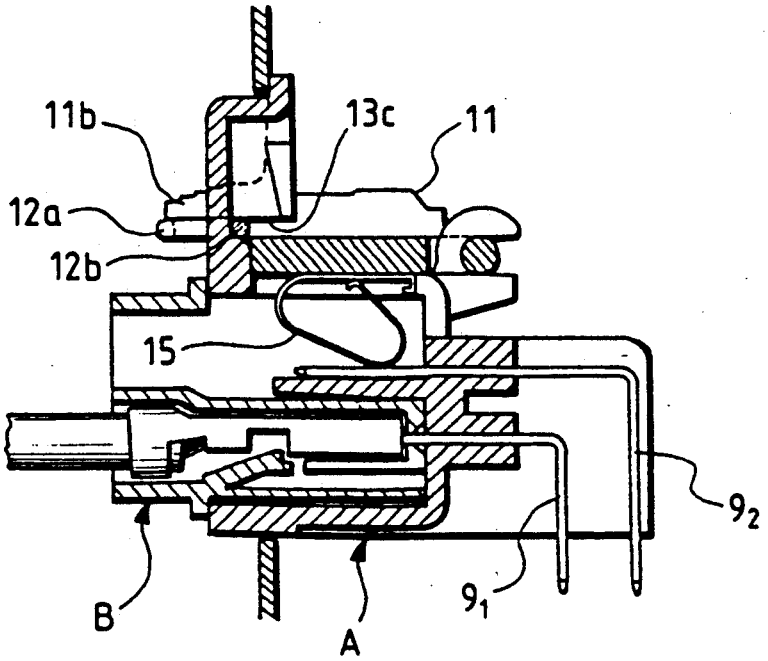

Referring to FIGS. 1 and 2, a female connector housing A, formed of a synthetic resin, is designed to accept male connector housings B, B', and B'' respectively. The female housing A is formed as a female connector of the type connected directly to a printed circuit board contained in an electronic unit case C.

Each of the male housings B, B', and B'' has a plurality of juxtaposed terminal receiving chambers 1 therein, and has on its external surface a locking arm 2 for the female housing A and an upstanding fitting confirmation projection 3. Each of the male housings B' and B" is a double-pole connector, and has arm guards 4 provided rearwardly of and on opposite sides of the locking arm 2, so as to prevent the arm 2 from being accidentally flexed by an external force. The male housing B has upper and lower rows of terminal receiving chambers 1, and has a recessed portion 5 in the upper row of the terminal receiving chambers 1. Locking arm 2 is provided in this recessed portion 5, thereby obviating the need for the abovementioned arm guards 4.

The female housing A has a hood 6 at its front half portion. A plurality of tab insertion holes 7 are formed in a rear half portion thereof in juxtaposed relation, as shown in FIG. 3(*a*). Male tabs 9*a* of L-shaped terminals 9, connected to circuit conductors (not shown) of a printed circuit board 8 by soldering or the like, are press-fitted in the respective tab insertion holes 7. The hood 6 has therein a plurality of partition walls 6*a* which divide the interior thereof into fitting chambers 10, 10'.. for the male housings B, B'..

A lock lever 11, having a holder spring 12 attached thereto, is pivotally mounted at one end on the rear edge portion of the hood 6. Two upstanding lock plates 13, 13 for holding the lever 11 in a provisionally-locked condition or a completely-locked condition are formed on the front edge portion of the hood 6. More specifically, the lock lever 11 has a plate-like shape. Engaging holes 11*a* are formed in the rear edge portion of the lock lever at the central and opposite ends, respectively, of the rear edge portion. C-shaped hooks 14, formed on the rear edge portion of the hood 6, are engaged respectively in the engaging holes 11*a*, as shown in FIG. 3(*a*), so that the lock lever 11 is pivotally supported by the hood 6.

The lock lever 11 has a manipulating press portion 11*b* at the central portion of the front edge portion thereof, a screen portion 11*c* extending from the press portion 11*b* in an upstanding manner, and fitting confirmation projections 11*f* formed on and projecting from the reverse surface of the lock lever 11. The projections 11*f* are adapted to interfere respectively with the projections 3 of the housings B, B', and B". Additionally, a short-circuit terminal 15 is fixed to the lock lever 11. Each of the fitting chambers 10, 10'.. of the hood 6 has a slit 6*b* into and out of which a respective one of the projections 3 and a respective one of the projections 11*f* are moved.

The holder spring 12 has a central U-shaped lock release sides of the lock release portion 12*a*, resilient support arm portions 12*d* connected respectively to the lock portions 12*b* via respective curved portions 12*c* and directed toward each other, and retaining pins 12*e* extending respectively from the support arm portions 12*d* and bent downwardly.

The holder spring 12 is formed by bending a resilient metal wire such as a piano wire, and the lock release portion 12*a* and the lock portions 12*b* on the right and left sides of the portion 12*a* are so disposed as to extend respectively along the press portion 11*b* of the lock lever 11 and the front end portion of the lock lever 11. The curved portions 12*c* are engaged respectively with spring holders 11*d* formed on the lock lever 11, and the retaining pins 12*e* are fitted respectively in pin holes 11*e*, thereby fixing the holder spring 12 to the lock lever 11. In order to allow the lock portions 12*b* to be deformed resiliently forward and backward, as indicated by the double-headed arrow in FIG. 3(*a*), notches 11*g* are formed in the lock lever 11 on the opposite sides of the press portion 11*b*.

The right and left lock plates 13 on the hood 6 have a frame-like configuration. A provisional locking groove 13*b* and a complete locking groove 13*c* are formed respectively in upper and lower portions of each of the opposed inner walls 13*a* of the lock plates 13. Each lock portion 12*b* of the holder spring 12 is engageable with the corresponding provisional and complete locking grooves 13*b* and 13*c*. The inner wall 13*a* has an inclined surface 13*d* lying between the two grooves 13*b* and 13*c* and slanting toward the lock lever 11. The complete locking groove 13*c* is deeper than the provisional locking groove 12*b*.

The female housing A has stoppers 6*c* formed respectively on the upper and lower outer surfaces of the hood 6 and the outer surface of each lock plate 13. The female housing A has mounting brackets 16 formed respectively on the opposite end walls thereof and having respective screw holes 16*c*.

As shown in FIG. 2, the female housing A is fitted in a window 17 (which is open to the front of the electronic unit case C) from the inside of the case C, and is held in position by the stoppers 6*c*. Thereafter, the mounting brackets 16 are fixed by respective screws to respective mounting portions (not shown) provided within the case. The window 17 has a small window 17*a* at its upper central portion for the manipulation of the lock lever. The printed circuit board 8 (FIG. 3(*a*)), having control circuits for an air-bag device and other control devices, as well as other electronic devices, is housed in the electronic unit case C.

The electric connector fitting confirmation operation by the lock lever 11 now will be described with reference to FIGS. 3(*a*) to 3(*e*). In FIG. 3(*a*), one end of the lock lever 11 is pivotally connected through the engagement of the hooks 14 with the engaging holes 11*a*, and the other end (front edge portion) of the lock lever is supported so that the lock portions 12*b* of the holder spring 12 are respectively held in contact with the edges of the walls 13*a* of the lock plates 13. The lock lever 11 can be easily removed by pulling up on the lock lever 11.

As shown in FIG. 3(*b*), when the press portion 11*b* is depressed by an operator's finger in the direction of the arrow, the lock portions 12*b* are resiliently retracted and also descend. When the lock portions 12*b* reach the provisional locking grooves 13*b* as shown in FIG. 3(*c*), the lock portions 12*b* are resiliently restored, so that the lock lever 11 is provisionally locked relative to the hood 6 in an inclined condition. In this provisionally locked condition, for example, the male housing B is inserted into the fitting chamber 10 of the hood 6.

At this time, the projection 3 on the outer surface of the housing B is guided into the slit 6*b* of the hood 6 and advances. When the male housing B is completely fitted, the retaining projection 2*a* of the locking arm 2 is engaged with a retaining portion 6*d* on the inner wall of the fitting chamber, so that the female and male housings A and B are primarily locked together.

Simultaneously, as shown in FIG. 3(*c*), a female metal terminal 18, fixedly received in each terminal receiving chamber 1 of the male housing B, is electrically connected to the corresponding male tab 9*a* of the L-shaped terminal 9 in the lower row within the female housing A.

Thereafter, when the lock lever 11 is depressed as shown in FIG. 3(*d*), the lock portions 12*b* slidingly move downward along the respective inclined surfaces 13*d* and also are retracted against their resilient force. Upon reaching the complete locking grooves 13*c*, the lock portions 12*b* are released, and are resiliently restored as shown in FIG. 3(*d*), so that the lock lever 11 is completely locked. Simultaneously, the projection 11*f* on the reverse surface of the lock lever 11 moves through the slit 6*d* into the fitting chamber 10, and is disposed rearwardly of the projection 3 on the male housing B so as to serve as a stopper. Therefore, the two housings A and B are secondarily locked together.

At this time, two contact pieces 15*a* of the short-circuit terminal 15 provided on the reverse side of the lock lever 11 are respectively held in contact with the adjacent L-shaped terminals $9_2$ in the upper row within the female housing A. Therefore, if an alarm circuit associated with a lamp or a buzzer has been provided on the printed circuit board 8, the complete fitting of the two housings A and B, as well as the double lock condition thereof, can be detected electrically.

In FIG. 3(*d*), if the male housing B is left in an imperfect fitting condition, the aforesaid primary locking operation is not achieved, and also the projection 11*f* of the lock lever 11 interferes with the projection 3 of the male housing B, thus preventing the complete locking of the lever 11. Even if the lock lever 11 is depressed, the lock portions 12*b* move upwardly along the inclined surfaces 13*d* due to their resilient forces, thereby returning the lock lever into the provisionally locked condition shown in FIG. 3(*c*). As a result, the short-circuit terminal 15 is not brought into contact with the L-shaped terminals $9_2$, and therefore the above-mentioned alarm circuit will not be operated.

Thus, the lock lever 11 performs the function of confirming the complete fitting condition of the two housings and also performs the function of locking the two housings together. Therefore, if the primary locking mechanism (the locking arm 2 and the retaining portion 6*d*) is provided with respect to the two housings as is the case with the conventional systems, the double lock is achieved, and in the completely locked condition of the lock lever 11, the primary lock is not released.

To release the complete locking condition or the provisional locking condition of the lock lever 11, as shown in the condition represented by FIG. 3(*e*), the lock release portion 12*a* of the holder spring 12 exposed below the press portion 11*b* is strongly pressed by a screwdriver or the like.

Since the projections 11*f* for interfering with the projections 3 of the male housings B', B''.. are also provided on the reverse surface of the lock lever 11, the complete locking of the lock lever 11 is not achieved until all of the male housings are completely fitted and primarily locked.

Figure 4A:
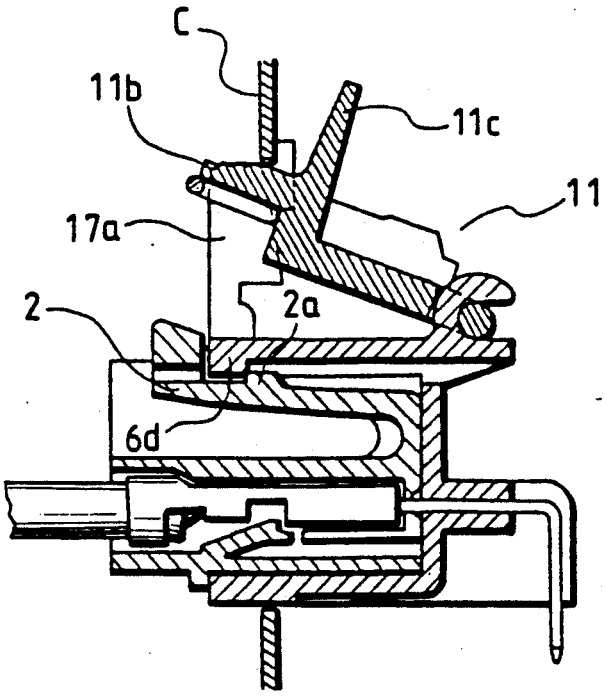
FIGS. 4(*a*) and 4(*b*) are cross-sectional views, showing the operation of a screen portion of the lock lever.
Figure 4B:
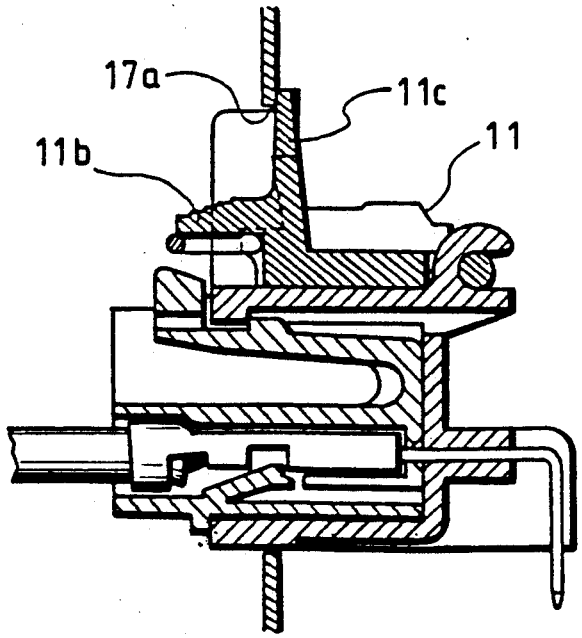

When the female housing A is attached to the electronic unit case C as described above, a small window 17*a* for use in manipulating the lock lever 11 is partially opened in the provisionally locked condition (e.g., as shown in FIG. 4(*a*)) of the lever 11. When foreign matter, such as steam and dust, penetrates through such an open portion into the case C, the circuit therein may be contaminated, corroded, or short-circuited. To prevent such a situation, the screen portion 11*c* provided on the press portion 11*b* closes the small window 17*a* when the apparatus is in the completely locked condition, thereby preventing the above problems.

Figure 5:
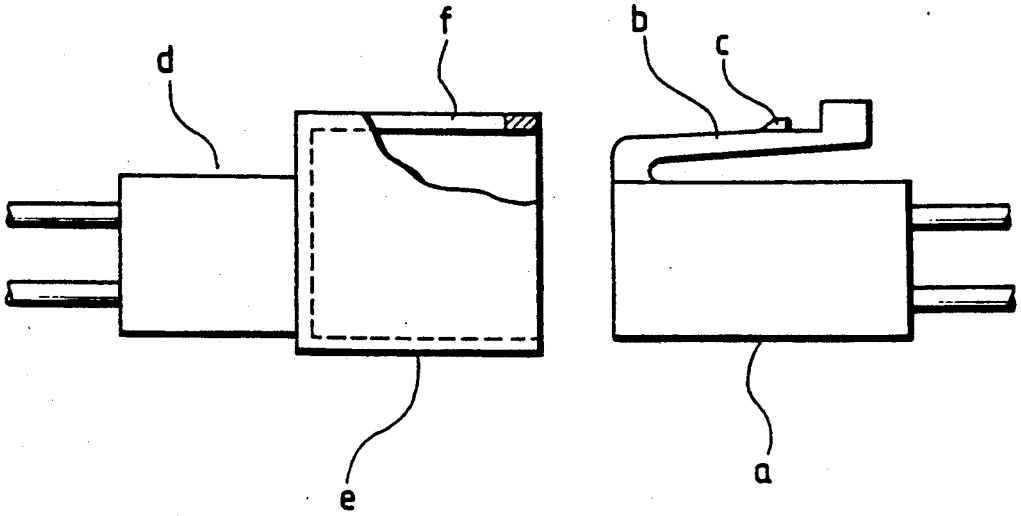
FIG. 5 is a view of a conventional electric connector having a locking device.

In the above embodiment, the female connector housing A is connected directly to the printed circuit board, and the plurality of male housings B, B', B''.. are adapted to be fitted into the female housing A. However, the present invention can be applied to a conventional electric connector, such as that shown in FIG. 5, in which the male and female housings d and a are used to interconnect two electric cables together.

The lock lever 11 may be connected to the hood 6 by any other suitable pivotal connecting mechanism such as a hinge connection or a pin connection. Further, the projection 3 formed on the male housings B, B', B''.. may be replaced by a retaining groove into which the projection 11*f* of the lock lever 11 is insertable in the complete fitting position.

As described above, in the present invention, when the female and male connector housings are completely fitted together, the lock lever is completely locked. Therefore, an imperfect fitting of the two housings can be prevented, the complete fitting of the two housings can be confirmed easily, and the locking operation can be performed positively. If the conventional primary lock mechanism such as the locking arm also is provided, a double lock is achieved, thus markedly improving the reliability of the electrical connection.

Additionally, if the screen portion is formed on the manipulating press portion of the lock lever, foreign matter is prevented from penetrating the unit case through the small manipulation window when the female housing is attached to the unit case, thus protecting the internal circuit.

While certain preferred embodiments have been shown and described, many changes and modifications within the spirit of the invention will be apparent to those of working skill in this technical field. Thus, the scope of the invention should be considered as limited only by the appended claims.

What is claimed is:

1. An apparatus for confirming the fitting of an electric connector wherein a male connector housing is fitted in a hood of a female connector housing so as to connect together metal terminals received respectively in terminal receiving chambers of said male connector and female connector housings, said apparatus comprising:

a lock lever, having a holder spring, pivotally connected at one end thereof to a first side portion of said hood;

a lock plate, having a provisional locking groove and a complete locking groove separated by an inclined surface, formed on a second side portion of said hood, said provisional and complete locking grooves being engageable with said holder spring; and a fitting confirmation projection formed on a reverse surface of said lock lever, said fitting confirmation projection interfering with said male connector housing when a fitting of said male connector housing into said hood of said female connector housing is imperfect, thereby preventing an engagement between said holder spring and said complete locking groove.

2. An apparatus as defined by claim 1, further comprising a hinge for connecting said lock lever to said first side portion of said hood.

3. An apparatus as defined by claim 1, wherein said complete locking groove is deeper than said provisional locking groove.

4. An apparatus as defined by claim 1, wherein said provisional and complete locking grooves are formed in upper and lower portions, respectively, of inner walls of said lock plate.

5. An apparatus as defined by claim 1, wherein said inclined surface slants toward said lock lever.

6. An apparatus as defined by claim 1, wherein said fitting confirmation projection is disposed rearwardly of a projection formed on said male housing so as to interfere with said projection formed on said male housing when said fitting is imperfect.

7. An apparatus as defined by claim 1, wherein said fitting confirmation projection is disposed rearwardly of a retaining groove formed on said male housing so a not to be engageable with said retaining groove formed on said male housing when said fitting is imperfect.

8. An apparatus for confirming the fitting of an electric connector wherein a hood of a female connector housing is fitted in an electronic unit case so as to provide an open window in said electronic unit case, and a male connector housing is fitted in said hood so as to connect together metal terminals received respectively in terminal receiving chambers of said female connector and male connector housings, said apparatus comprising:

a lock lever, having a holder spring, pivotally connected at a first end thereof to a first side portion of said hood;

a lock plate having a provisional locking groove and a complete locking groove, said provisional locking groove and said complete locking groove being separated by an inclined surface formed on a second side portion of said hood, said provisional locking groove and said complete locking groove being engageable with said holder spring;

a fitting confirmation projection formed on a reverse surface of said lock lever, said fitting confirmation projection interfering with said male connector housing when a fitting of said male connector housing is imperfect, thereby preventing an engagement between said holder spring and said complete locking groove;

a manipulation press portion formed on a second end of said lock lever; and a screen portion formed on said press portion so as to close said open window in said electronic unit case.

9. An apparatus as defined by claim 8, further comprising a hinge for connecting said lock lever to said first side portion of said hood.

10. An apparatus as defined by claim 8, wherein said complete locking groove is deeper than said provisional locking groove.

11. An apparatus as defined by claim 8, wherein said provisional and complete locking grooves are formed in upper and lower portions, respectively, of inner walls of said lock plate.

12. An apparatus as defined by claim 8, wherein said inclined surface slants toward said lock lever.

13. An apparatus as defined by claim 8, wherein said fitting confirmation projection is disposed rearwardly of a projection formed on said male housing to interfere with said projection formed on said male housing when said fitting is imperfect.

14. An apparatus as defined by claim 8, wherein said fitting confirmation projection is disposed rearwardly of a retaining groove formed on said male housing so as not to be engageable with said retaining groove formed on said male housing when said fitting is imperfect.

15. An apparatus as defined by claim 8, wherein said apparatus further comprises releasing means for releasing said lock lever from a provisionally locked condition and a completely locked condition.

16. An apparatus as defined by claim 8, wherein said manipulation press portion is depressed so as to simultaneously retract resiliently portions of said holder spring in a rearward and downward manner.

17. An apparatus as defined by claim 8, wherein said holder spring is engaged with said provisional locking groove.

18. An apparatus as defined by claim 8, wherein said male housing is inserted into said hood so as to fit said male housing completely in said hood and so that said male and female housings ar locked together.

19. An apparatus as defined by claim 8, wherein said lock lever is depressed so that portions of said holder spring reach said complete locking groove, thereby locking said lock lever in a completely locked condition, and simultaneously said fitting confirmation projection is moved so as to be disposed rearward of said projection on said male housing.

* * * * *